US005354519A

United States Patent [19]

Kaeser

[11] Patent Number: 5,354,519

[45] Date of Patent: Oct. 11, 1994

[54] METHOD AND APPARATUS FOR THE QUASI-ISOSTATIC PRESSURE-FORMING OF THERMOPLASTICALLY-BONDED PRECISION EXPLOSIVE CHARGES

[75] Inventor: Rudolf Kaeser, Thun, Switzerland

[73] Assignee: Schweizerische Eidgenossenschaft Vertreten Durch Die Eidg. Munitionsfabrik Thun der Gruppe fur Ruestungsdienste, Thun, Switzerland

[21] Appl. No.: 31,590

[22] Filed: Mar. 16, 1993

[30] Foreign Application Priority Data

Mar. 18, 1992 [CH] Switzerland ..... 874/92

[51] Int. Cl.[5] ..... C06B 21/00

[52] U.S. Cl. ..... 264/3.1; 264/3.4; 86/20.11

[58] Field of Search ..... 264/3.1, 3.4; 86/20.11

[56] References Cited

U.S. PATENT DOCUMENTS

| | | | |
|---|---|---|---|
| 3,172,153 | 3/1965 | Loomis et al. | 18/5 |
| 3,600,486 | 8/1971 | Walker et al. | 264/89 |
| 3,628,779 | 12/1971 | Lundstrom | 266/5 E |
| 4,330,251 | 5/1982 | Lebas et al. | 425/405 H |
| 4,496,299 | 1/1985 | Pettersson | 425/405 H |
| 4,710,329 | 12/1987 | Lebas et al. | 264/3.1 |
| 4,920,079 | 4/1990 | Kaeser et al. | 264/3.1 |
| 4,978,482 | 12/1990 | Johnson et al. | 264/3.1 |
| 5,230,841 | 7/1993 | Redecker et al. | 264/3.1 |

FOREIGN PATENT DOCUMENTS

| | | |
|---|---|---|
| 2108519 | 9/1972 | Fed. Rep. of Germany . |
| 1147945 | 12/1957 | France . |
| 2114101 | 6/1972 | France . |
| 1483286 | 8/1977 | United Kingdom . |

*Primary Examiner*—Peter A. Nelson

*Attorney, Agent, or Firm*—Schweitzer Cornman & Gross

[57] ABSTRACT

A quasi-isostatic pressure-forming methods for the production of precision explosive charges consists of the pre-heating of the explosive mass to be pressure-formed is now preheated to 100–120° C. with subsequent forming in an autoclave at pressures of an order of magnitude of 3500 bar during 0.5–5 min. After pressure relief during a further phase of 10–180 min, the mass is cooled down at pressures of 50–500 bar. In a further elaboration of the invention, two autoclaves, one high pressure and one low pressure, may be utilized.

17 Claims, 7 Drawing Sheets

A
117

103
106
113
113
118
114
102
1'
115
104
105
105
105
100
100'
116'
101
116
107
A

METHOD AND APPARATUS FOR THE QUASI-ISOSTATIC PRESSURE-FORMING OF THERMOPLASTICALLY-BONDED PRECISION EXPLOSIVE CHARGES

The present invention relates to a new and improved method and apparatus for the preparation of precision explosive charges at room temperature and ensures low internal stresses, while maintaining an elevated homogeneity also in critical zones. The basic method of which the present invention is an improvement is known from EP-A1-0 296 099.

BACKGROUND OF THE INVENTION

It is a disadvantage of the known art that, when the preparation of an explosive charge takes place at room temperature, plastics-bonded charges do not, or only to a very limited degree, permit the utilization of the favorable properties of a bonding agent, thus for all practical purposes limiting known methods to the pressure-forming of non-thermoplastically bonded substances which frequently exhibit inadequate mechanical properties.

Plastics-bonded explosive charges of simple shape, so-called briquettes, have in the past been isostatically warm-pressed in pre-heated rubber bags at a temperature of 120° C. (Lawrence Livermore National Laboratory, California/Livermore, 1977; USRL-52350, distr. of doc. unlimited). These laboratory experiments were carried using the per se known thermoplastic high-yield explosives of the LCX-14-0 and LX-14-1 types (explosives based on cyclotetramethylene tetranitramine (Octogen) of the Lawrence Livermore National Laboratory), with the charges being successfully tested with respect to their performance and their mechanical and thermal properties.

The method described in the above-mentioned document is not suitable for a series production of practical precision charges, i.e., of charges for use with conventional arms. It is uneconomical and limited to the direct production of only the simplest geometrical shapes.

It is thus an object of the present invention to provide a method and an apparatus facilitating the safe production of precision charges of high homogeneity and density, shaped with at least partial rotational symmetry and, in particular, of thermoplastically bonded charges at a temperature elevated relative to room temperature.

A further object of the present invention is to provide such a method and apparatus which is suitable for the series production of such charges.

BRIEF DESCRIPTION OF THE INVENTION

The method of the present invention comprises the quasi-isostatic pressure-forming of precision explosive charges in which as a first step, charge material is placed in an elastic envelope. The envelope and its surroundings are evacuated, sealed and preheated. The preheated charge mass mold is then subjected to high pressure of 500 to 5000 bar. for 0.5 to 5 minutes, followed by pressure relief and a controlled cooling phase of 10 to 180 minutes, during which time the pressure is maintained at the level of 50 to 500 bar.

With suitable process control the method permits the simultaneous production of several precision charges.

The splitting of the high-pressure phases into two separate steps provides economies and serves to increase output. It facilitates the production of at least 150 precision charges within 24 hours. The risks expected by the experts notwithstanding, the method of the present invention has proved to be highly safe operationally, and permits a great many of plastics-bonded high-performance explosives to be turned into precision charges.

Preheating of the masses to be pressure-formed may be effected in a conventional laboratory autoclave and can be temporally optimized depending on the thermal conductivity and mass of the explosive, particularly simple to handle as the pressure medium is warm water or a water mixture, whereby cooling of the explosive during the pressing stage can be minimized. Subsequent transfer to a low-pressure autoclave is then particularly advantageous, as the low-pressure autoclave and the pressure-formed masses remain dry, obviating appropriate cleaning and/or drying processes.

The apparatus of the present invention includes a high-pressure mold having a non-deformable outer body lined with an elastic envelope. A heat-drawing body preferably in the form of a mandrel or flange and coupled insert, is provided to allow cooling of the loaded explosive mass to be controlled.

Such a device has the advantage of easy handling and ensures a favorable cooling behavior of the explosive. The device can be easily adapted to most of the conventional shapes of explosive bodies, and the head-drawing mandrel and/or insert and/or flange can be designed in such a manner that the quasi-isostatic distribution of pressure on the pressure-formed article is ensured.

The use of an insert, longitudinally movable, can take into account the reduction of the volume of the charge article during the pressing stage, obviating the need for large allowances for shape, producing waste or machining expenses, while the inclusion of heat-drawing means able to be coupled to the heat-drawing body enhances the efficacy of the method, allowing cooling to be controlled.

The mold and outer body may be formed of a liquid-permeable structure, allowing the housing to remain pressure-free and thus able to be made with correspondingly thin walls. When constructed in the form of a perforated jacket, a considerable reduction of expense for producing the mold can be obtained.

The use of liquid-containing heat drawing means, as well as commercially available Peltier-elements, allows a simplification of the design and effective systematic control of the course of temperature.

The incorporation of a yoke structure surrounding a pressure chamber for the high-pressure autoclave makes for a simple and durable design. The yoke may be movable in the horizontal plane to permit loading of the pressure chamber. This further can insure simplicity of charging without compromising the mechanical reliability of the installation.

Embodiments and examples of calculations are represented in the drawings below.

BRIEF DESCRIPTION OF THE INVENTION

Figure 4:
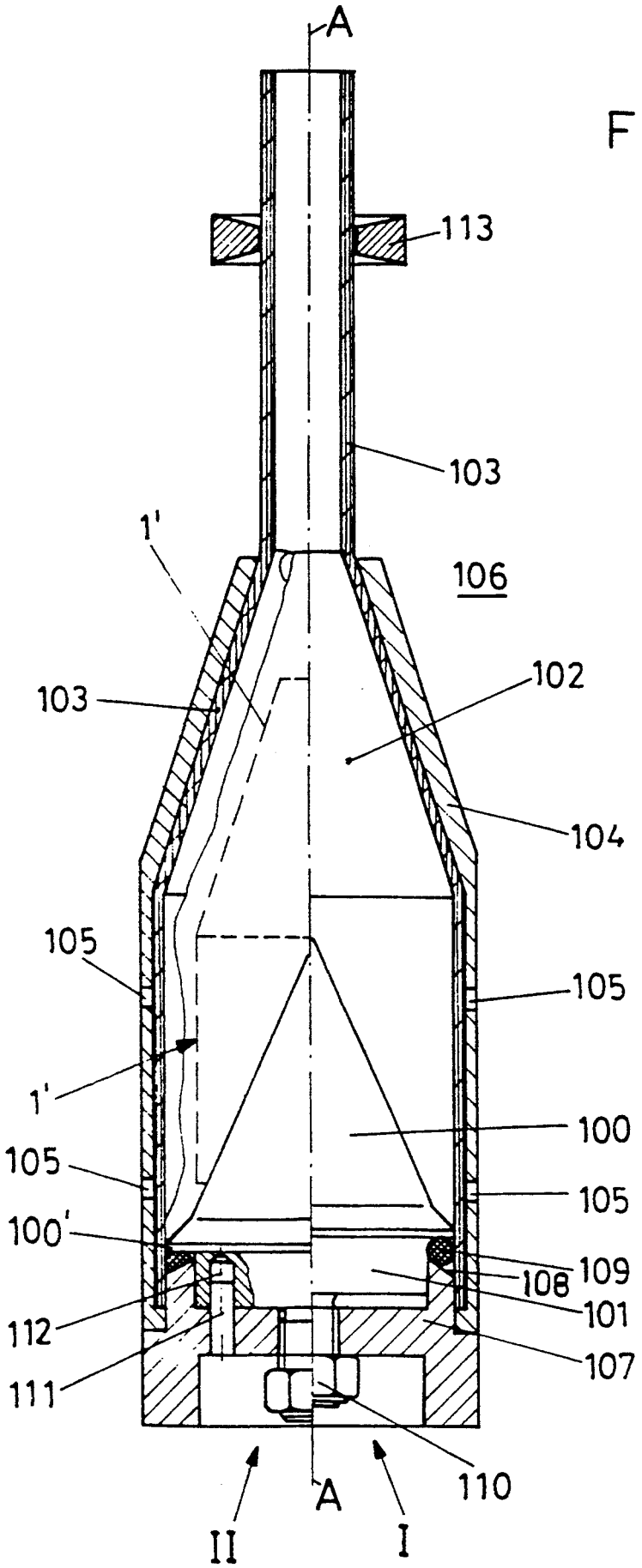
FIG. 4 represents a bisected presentation of a pressing mold for the production of precision charges according to the invention.

A charge mass to be pressure formed and compacted according to the present invention is first introduced into a pressing mold 106 as depicted in FIG. 4. As presented therein the mold has an axis of rotational symmetry A. A nondeformable and heat-drawing body 100 provided is of conical shape and, at its lower portion, is provided with a heat sink 101. At its widest edge zone 100', the nondeformable body 100 is enclosed by an elastic envelope 103 which, in turn, abuts against a metallic housing 104 that has several perforations 105 and which extends upwardly to about and above the body 100 to define a mold cavity.

A flange 107 serves as a lower contact surface and has a chamfered face 108 on which rests an O-ring 109 made of synthetic rubber. From the flange 107 project three guide pins 111, uniformly distributed peripherally, which align with the holes 112 of the heat sink 101. A threaded bolt 110 projects in the downward direction from the heat sink through the flange and is of such a length that, in its position of rest, i.e., without pressure loading, it can be tightened such that the body 100 compresses the O-ring 109 only minimally (position I). In the presence of a pressure load, however, the body 100, against the elastic bias of the O-ring 109, pushes down the heat sink 101, serving as heat capacitor, as shown in position II.

The pressing mold 106 is charged with explosive powder 102 and/or granulate via the hose-like end of the elastic envelope 103 and subsequently evacuated down to about 20 mm Hg, and then closed by means of a hose clamp 113. The mass to be pressure-formed is pre-heated to a temperature of 100°–200° C., and then exposed to pressure in the autoclaves 30 or 50, where it is compacted and turned into the pressure-formed article 1', the final shape of which is shown in FIG. 4 by broken lines.

Figure 5:
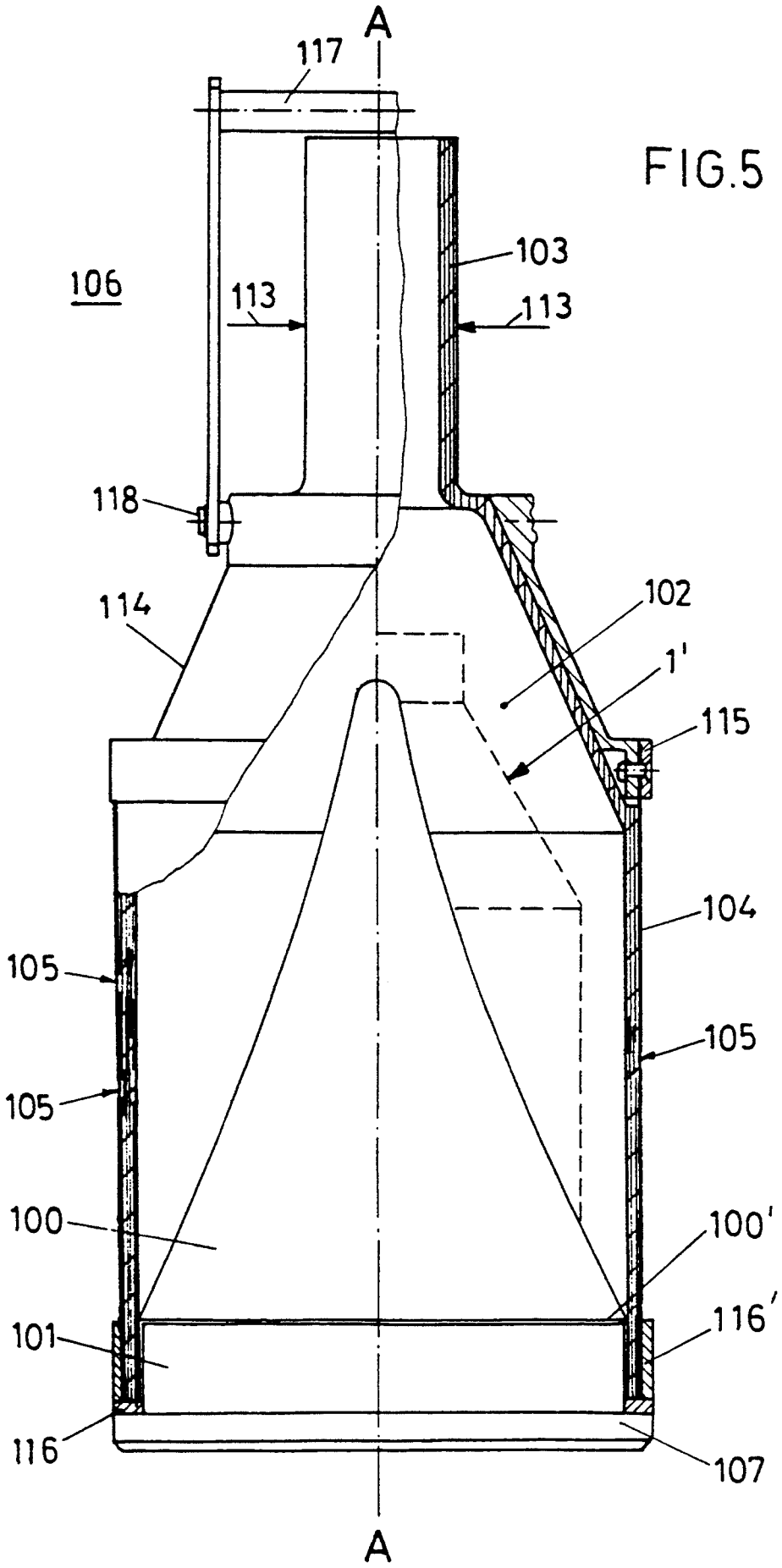
FIG. 5 is a variant of the mold of FIG. 4 for a different explosive charge.

Another pressing mold 106, as shown in FIG. 5, is of an analogous design. On top of the housing 104, here cylindrical, is mounted a conical part 114 fixedly attached to the housing 104 by means of a joining ring 115 riveted thereto. At its lower end, the housing is joined to a flange 107 by means of rigid rings 116, 116'.

For more convenient handling, there is further provided a carrying handle 117 mounted to the bottom of the conical part 114 by means of pivots 118.

In this embodiment, the surface area of the flange 107 is relatively large, producing good thermal contact, enabling the energy stored in the heat sink 101 and in the body 100 to be rapidly transferred to the bottom surface of the autoclave 50 or 30.

Figure 1:
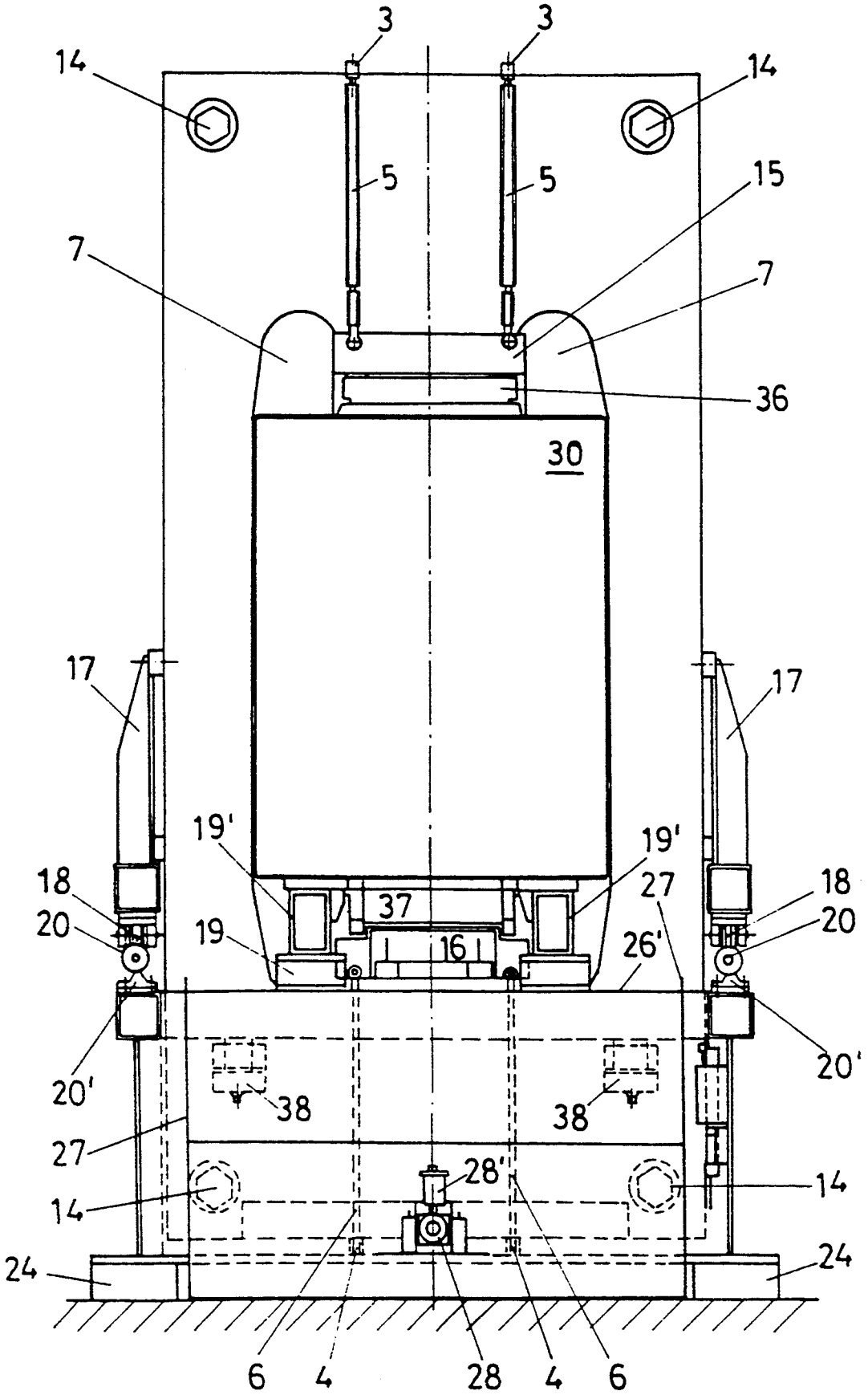
FIG. 1 shows a frontal view of a high-pressure autoclave utilized in the present invention.
Figure 2:
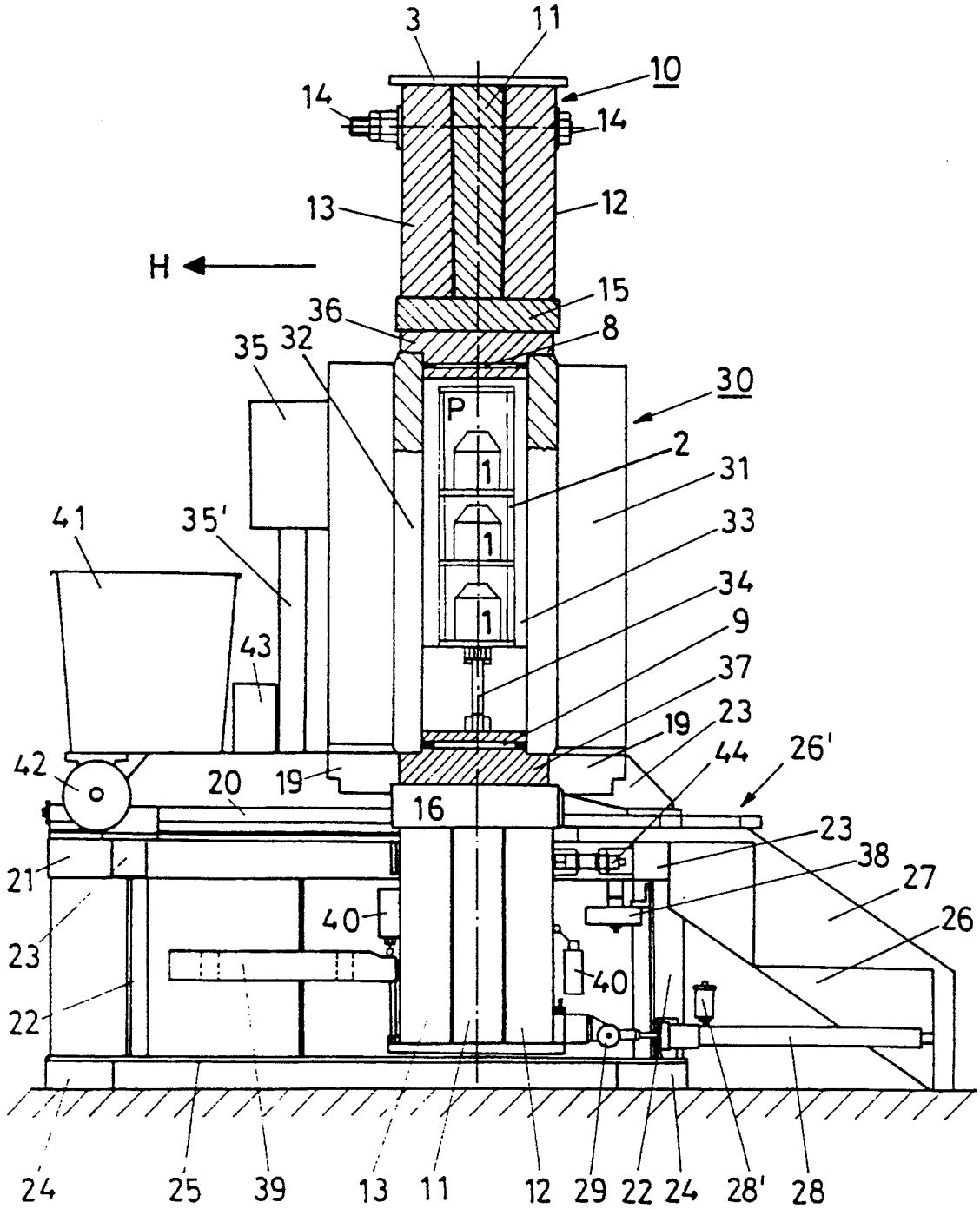
FIG. 2 is a partial cross-sectional lateral view of the autoclave of FIG. 1.

As shown in FIG. 1 and FIG. 2, after filling the pressing mold and charge mass 1 is introduced into a high-pressure autoclave 30 in a basket 2. The autoclave consists of a massive outer jacket 31 and an inner jacket 32 made of high-strength steel, forming a high-pressure chamber 33 in which a hydraulic pressure P of up to a maximum of 5000 bar. is produced in a manner known to those skilled in the art.

The basket 2 rests on a filler body 34, permeable at its center to liquids, with which body the dead volume and thus the time required for pressure build-up and pressure fall can be easily adapted to the degree of filling of the chamber 33.

The chamber 33 is closed off at its end by a top flange 36 with an annular seal 8, and a bottom flange 37 with a seal 9. The flanges 36 and 37 abut against the pressure pads 15 and 16 which are, in their turn, fixedly attached to a yoke 10 by means of tie bars 5 and 6 via cross bars 3 and 4.

The yoke 10 consists of a middle portion 11 (FIG. 2), as well as lateral portions 12, 13 and is held together by means of bolts 14. It is further provided with a cutout 7 (see FIG. 1) and, under normal pressure conditions, can be horizontally slid or moved over the high-pressure chamber 33.

The installation of FIGS. 1 and 2 is mounted on the shop floor; a stand 22 with beams 21 and struts 23 rests on a base plate 25 with levelling pads 24.

A set of stairs 26 with stair strings 27 lead to a platform 26', from which, when the yoke 10 is horizontally moved in the direction of arrow H in FIG. 2 the autoclave can be charged by an operator. A console 35 is mounted on a support 35' through which are led the electric control cables for the moving of the yoke 10 and for the filling process of the chamber 33.

Guide bars 20 on supports 20' (see FIG. 1), on which travel rollers 18 in guide brackets 17, serve as transport rails for the yoke 10. The autoclave 30 remains stationarily on its mounts 19, 19'. The yoke 10 is moved by a linearly operating hydraulic cylinder 28 with oil reservoir 28', via a hinge coupling 29. The terminal positions for yoke travel are maintained by limit switches 40, one of which senses a cam rail 39. A shock absorber 44 prevents undesirable mechanical impacts in the installation.

The filling process in the high-pressure chamber 33 is carried out in stages: A low-pressure pump 42 pumps the pressure medium—essentially water with a per se known anticorrosive additive—from the water tank 41 into the chamber 33. After the maximum filling quantity has been attained and the chamber 33 has been deaerated, a pressure of several bar is generated, controlled by a valve unit arranged in a block 43. The pump lines are closed, with the flanges 36 and 37 now fully abutting against the pressure pads 15 and 16. Now the high-pressure valves 38 open the connection to high-pressure pumps located in an adjacent room (not shown) and produce, controlled in dependence on time, a rate of pressure rise of up to 1000 bar/min. In the example of the explosive LX-14, a maximum pressure of 3500 bar is attained. This pressure is maintained for 1.0 to 1.5 min. After compaction has been achieved, the pressure is systematically relieved at a rate of 2000 bar/min.

This type of hydraulic compaction of the explosive involves only a minimal risk, in spite of the highly brisant nature of this explosive. Moreover, the method can also be carried out behind armored walls, so that even a possible accident would not lead to injury of personnel.

Figure 3:
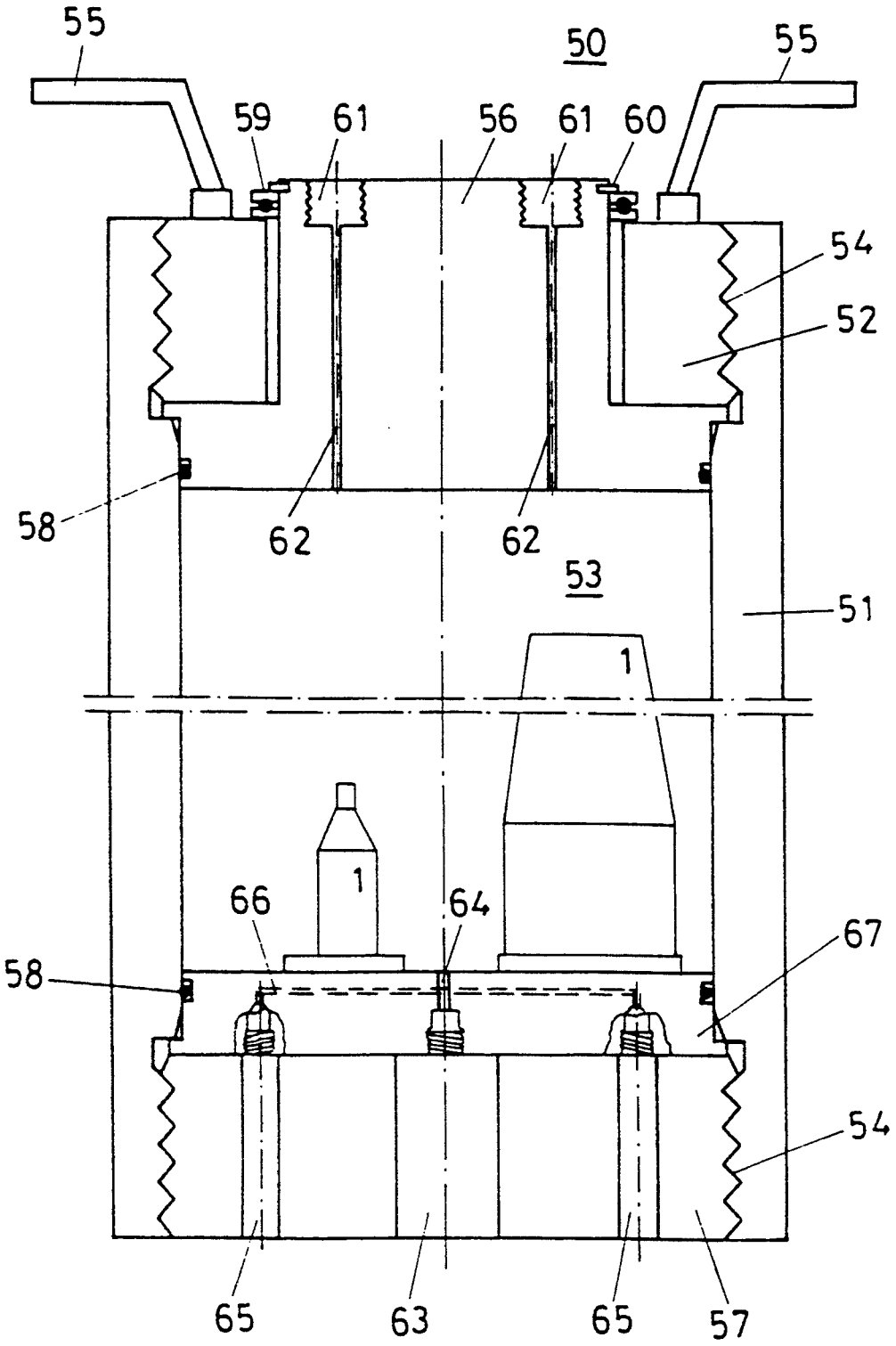
FIG. 3 is a simplified view of low-pressure autoclave of the invention.

The low-pressure autoclave (FIG. 3) used according to the method, comprises a jacket 51 into which a ring 52 carrying a thread 54 is screwed by means of handles 55. The ring 52 locks into position a top flange 56 with a peripheral O-ring 58. An annular holder ring 59 with a retaining ring 60 constitutes the mechanical link between the threaded ring 52 and the top flange 56. Flange 56 is provided with valve connector sockets 61 which, communicating with bores 62, lead into the interior of the low-pressure chamber 53.

Located within chamber 53 is the cooling element 67, having an O-ring 58, on which are mounted the masses to be pressure-formed. The cooling element 67 is fixedly retained by chamber bottom 57, also provided with a thread 34. The bottom 57 is provided with coolant connector sockets 65 which are interconnected via coolant ducts 66. In the center of the bottom 57 there is provided a pressure connector 63 which, via a chamber gas inlet 64, the pressure medium is introduced into the chamber 53.

Nitrogen is suitable as a pressure medium in the low-pressure autoclave. The compressors required to produce a pressure of up to 500 bar are commercially available such as from Bauer Kompressoren GmbH, D-8000 Munchen 71; Typ I 25.18-75.

CALCULATION EXAMPLE

It is very difficult to experimentally investigate the cooling behavior of a precision charge, especially inside an operating high-pressure autoclave. Therefore, the method of "finite elements" was used to calculate the behavior of a charge of explosive of the type LX-14 having simple geometry commercial software, sold under the trademark ABACUS CODES of Hibit, Karlsson & Sorenson, Inc., Providence, R.I., U.S.A. was employed.

Calculations were based on a cylindrical charge of a length of 120 mm with a diameter of 50 mm resting on a steel cylinder of a length of 60 mm and a diameter of 60 mm. The charge is closed off by an envelope of synthetic rubber of a thickness of 4.0 mm, which is also slipped over the steel cylinder.

The following parameters were assumed:

Density of the explosive LX-14: 1.83 $10^3$ kg/m$^3$; heat conductivity according to LLNL Explosives Handbook, 1985, UCRL-52'997, pp. 6–4; specific heat from LLNL Explosives Handbook, 1985, UCRL-52'997, pp. 6–11.

The envelope is made of synthetic rubber (NEOPRENE, trademark of DuPont, U.S.A.). Density 0.9 $10^3$ kg/m$^3$; heat conductivity 0.15 W/m °K.; specific heat 2.01 kJ/kg °K.

Steel: density 7.85 $10^3$; heat conductivity 52 W/m °K.; specific heat 0.465 kJ/kg °K.

Further assumed was a heat transfer coefficient of the pressure medium/mass to be pressure-formed of 300 W/m °K. The thermal starting conditions are: temperature of the explosive (LX-14 granulate) 100° C., temperature of rubber and steel: 20° C.

So-called colored contour plots (not shown for graphic reasons) show a concentric temperature distribution after 200 sec. After 1000 sec to 2000 sec the zone of highest temperature has shifted from the outside to the inside. Cooling behavior is seen to be steady.

Figure 6A:
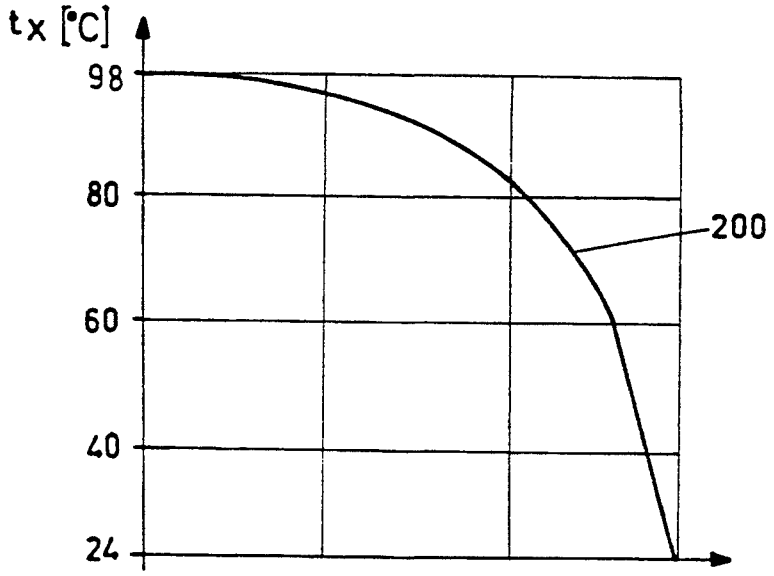
FIGS. 6a–6c show the calculated radial temperature distribution in a test sample.
Figure 6B:
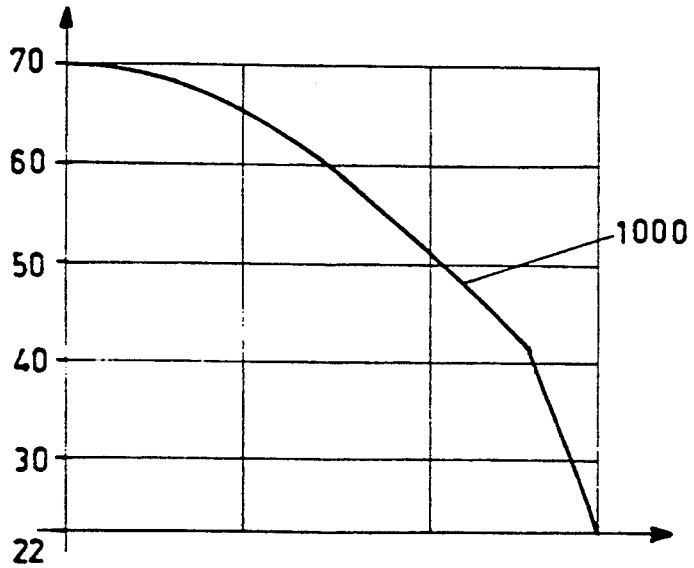
Figure 6C:
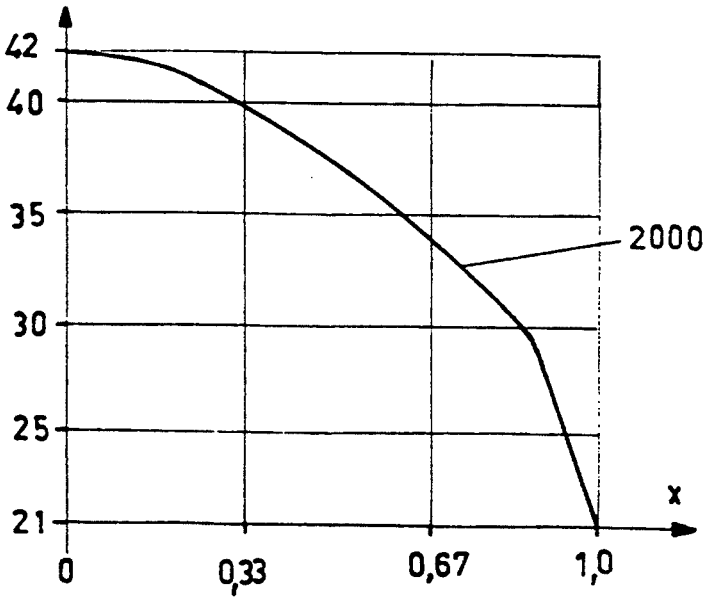

Somewhat different is the course of temperature in the radial direction, see FIGS. 6*a* to 6*c*. Here, as a result of the given geometry, slight breaks in the course of temperature can be discerned in the outer third of the radius x, with the latter being normalized to a value of 1.0. Temperature in FIG. 6*a* ranges between 24° and 98° C.; in FIG. 6*b* between 22° and 70° C.; and in FIG. 6*c* between 21° and 42° C. as plotted on the $t_x$ axis. Curve 200 shows the course of temperature at the end of 200 sec, curve 1000 shows the course of temperature at the end of 1000 sec, and curve 2000, at the end of 2000 sec after the filling-in of the explosive.

Figure 7A:
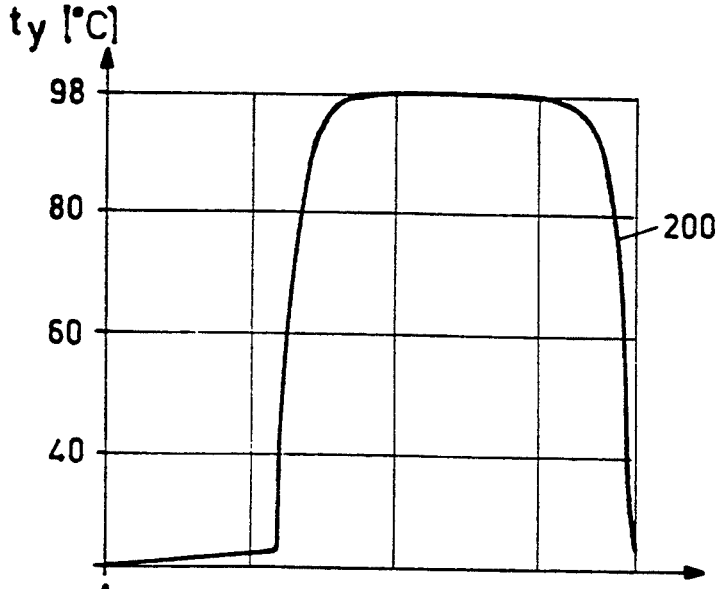
FIGS. 7a–7c show the calculated axial temperature distribution in the same test sample.
Figure 7B:
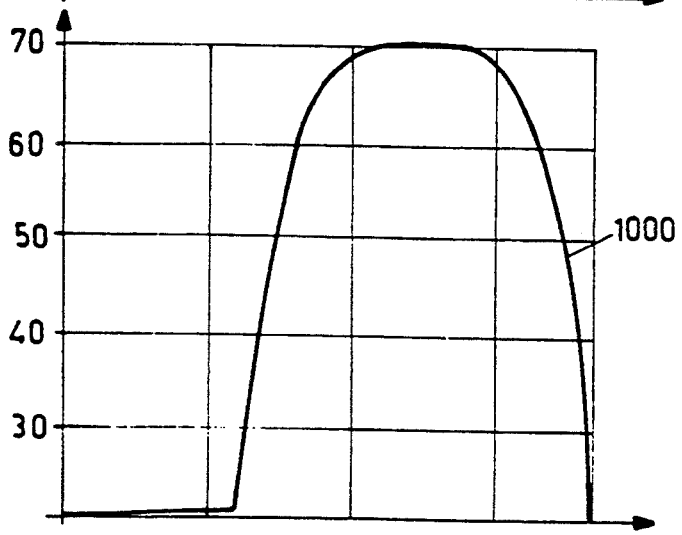
Figure 7C:
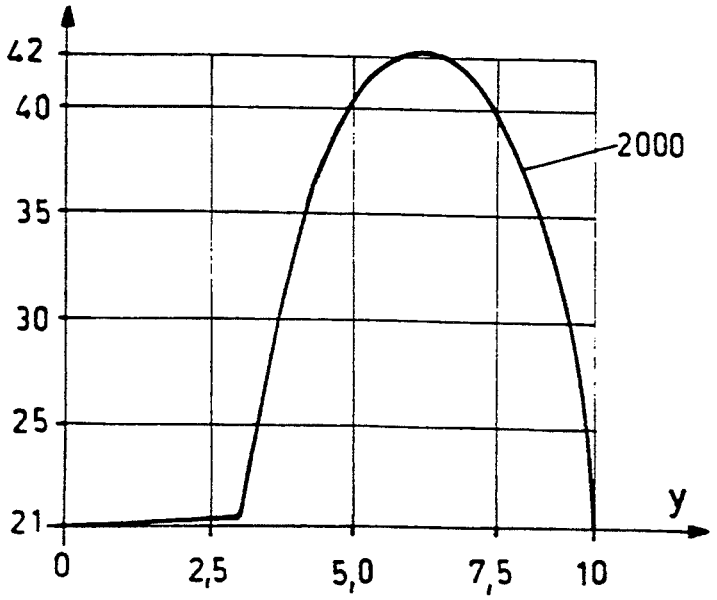

FIGS. 7*a* to 7*c* follow the same principle, with the y-axis (abscissa) here representing the axial extent of the charge, normalized to 10. Temperatures can be read off the $t_y$ axis.

The temperature distributions according to FIGS. 6*a* to 6*c* and 7*a* to 7*c* show that, within the cooling intervals dealt with, there exists no danger of detonation of the explosive due to temperature stresses. As shown by practical tests, this holds true also for more complex shapes, so that the method, initially regarded as too dangerous, can be utilized with full confidence for industrial mass production.

For the practical example of the quasi-isostatic pressure-forming of a hollow charge for a warhead of a calibre of 120 mm and a mass of 2 kg, the following preferred method appears to be appropriate:

a. The explosive, available in granulated form, is preheated in a commercially available heating chest to 120° C.;
b. The pressing mold 106 with its elastic envelope 103 is then sealed off at its base by the threaded bolt 110 and filled with the preheated explosive and subsequently evacuated by means of a laboratory vacuum pump to a pressure of 10 mbar;
c. As soon as vapors or gases cease to escape, the filling hose is sealed off by means of a hose clamp 113. Thus, the filled pressing mold 106 is introduced into the high-pressure autoclave 30 already filled with the pressure liquid preheated to 95° C.;
d. Subsequently, the autoclave 30 is pressurized to 3500 bar at a rate of 1 kbar/min, and
e. maintained at this maximum pressure for 1 min.
f. After compaction has been achieved, the overpressure is reduced to normal pressure at a rate of 2000 bar/min.
g. Subsequently, the press-formed article is transferred to the low-pressure autoclave 50 as rapidly as possible, and within 2.5 min., during which transfer no uncontrolled cooling of the explosive must take place;
h. Within 1 min, the pressure in the autoclave 50 is raised to 500 bar;
i. The maximum pressure of 500 bar is maintained until the temperature of the pressure-formed article has dropped to room temperature which, with a liquid pressure medium and a mass of 2 kg, is about 2 hours.
j. Subsequently, the pressure is reduced to normal pressure within 10 sec.
k. The pressure-formed article can now be subjected to mechanical working if necessary and/or is ready for building-in.

From the cooling behavior mentioned under (i) it is clear that it is primarily liquid media with good heat conductivity which are suitable as the pressure media for larger masses, while smaller masses are easily pressure-formable by an inert gas and coolable by corresponding means.

With liquid pressure media, one must be sure that their temperature, depending on atmospheric pressure, is sufficiently below their boiling point, and that formation of vapor bubbles is avoided.

The considerations and embodiments involved with the examples concerning rotationally symmetrical charges can be to a limited degree also applied to linear shear charges and/or similar, not rotationally symmetrical, charges, with, according to their configuration, the advantage of an isostatic or quasi-isostatic pressure course being lost. This could be partly compensated for by "overmasses", i.e., portions of the pressure-formed article which lack the required homogeneity could be eliminated by a subsequent mechanical working.

A simple cooling mode is possible by supplying a liquid medium such as water. It is, however, also possible to achieve this aim by building-in electrical connectors for Peltier-elements. The latter can also be directly built-in in the front part of the autoclave.

I claim:

1. A method for the quasi-isostatic pressure-forming of precision explosive charges of high density and homogeneity, wherein the inner or outer mold (100) is given by a nondeformable body of high surface quality and is at least partly rotationally symmetrical, which body has a finite slope relative to the axis of rotation (A) and wherein in a first method step the inner or outer mold is delimited by an elastic envelope (103), which envelope, in a positive locking relationship with respect to the largest edge zone (100'), is attached to the inner or outer mold and mechanically pressed thereonto, so that a chargeable pressing mold (106) is created, the hollow space in which, in a second method step, is filled with a pulverulent or granular explosive (102) and wherein the inner space and the explosive (102) as well as the space outside of the pressing mold are evacuated, and wherein in a third method step the inner space is closed off and the filled pressing mold (106) is introduced into a pressure chamber (33) and the interior of the pressing chamber (33) is subjected to a pressure (P), wherein the pressure (P) is continuously increased up to the attainment of a value predetermined by the density and mechanical strength of the explosive to be achieved in this method step, and wherein subsequently the filled pressing mold (106) is returned to normal pressure by a continuous pressure relief, characterized in that in the third method step the mass (1) to be pressure-formed is preheated and, in an autoclave (30), is exposed to a pressure of 500 to 5000 bar during a pressure-holding time of 0.5 to 5 min, and that, after a pressure relief, the pressure-formed mass (1), in a cooling phase of a duration of 10 to 180 min, is exposed to a pressure of 50 to 500 bar, and that, after a further pressure relief, the pressure-formed mass (1) is withdrawn from the autoclave (30) and the pressure-formed article (1') is removed for final mechanical working and/or mounting.

2. A method for the quasi-isostatic pressure-forming of precision explosive charges of high density and homogeneity, wherein the inner or outer mold (100) is given by a nondeformable body of high surface quality and is at least partly rotationally symmetrical, which body has a finite slope relative to the axis of rotation (A) and wherein in a first method step the inner or outer mold is delimited by an elastic envelope (103), which envelope, in a positive locking relationship with respect to the largest edge zone (100'), is attached to the inner or outer mold and mechanically pressed thereonto, so that a chargeable pressing mold (106) is created, the hollow space in which, in a second method step, is filled with a pulverulent or granular explosive (102) and wherein the inner space and the explosive (102) as well as the space outside of the pressing mold are evacuated, and wherein in a third method step the inner space is closed off and the filled pressing mold (106) is introduced into a pressure chamber (33) and the interior of the pressing chamber (33) is subjected to a pressure (P), wherein the pressure (P) is continuously increased up to the attainment of a value predetermined by the density and mechanical strength of the explosive to be achieved in this method step, and wherein subsequently the filled pressing mold (106) is returned to normal pressure by a continuous pressure relief, characterized in that the third method step is subdivided into two successive single steps, wherein in that first single method step the mass (1) to be pressure-formed is preheated and, in a high-pressure autoclave (30), is exposed to a pressure of up to 500 to 5000 bar during a pressure-holding time of 0.5 to 5 min, and that, after a pressure relief at a rate of 500 to 10000 bar/min, the pressure-formed mass (1) is removed from the autoclave and, in a further single step, is exposed in a low pressure autoclave (50), in a cooling phase of a duration of 10 to 180 min, to a pressure of 50 to 500 bar, and that, after a pressure relief at a rate of 1 to 100 bar/min, the pressure-formed mass (1) is withdrawn from the autoclave and the pressure-formed article (1') is removed for final mechanical working and/or mounting.

3. The method according to claim 1, characterized in that the mass (1) to be pressure-formed is preheated to a temperature of 100° to 120° C. during a time interval of 60 to 600 min.

4. The method according to claim 1, characterized in that, as pressure medium, water and/or a mixture of water-ethylene glycol with an anticorrosive is introduced into the pressure chamber (30) at a temperature above room temperature and below boiling temperature.

5. The method according to claim 1, characterized in that, as pressure medium, gas is introduced into the low-pressure autoclave (50).

6. A device for carrying out the method according to claim 1 or 2 by means of a pressure mold (106) which contains a nondeformable inner or outer body (100) of high surface quality and the inner space of which mold (106) is formed by an elastic envelope (103), characterized in that in the region of the axis of rotation (A) of the pressure mold (106) there are provided at least a heat-drawing mandril (100, 101) and/or an insert and/or a heat-absorbing flange (107).

7. The device according to claim 6, characterized in that, for sealing off the gap between the nondeformable body (100, 100') and the elastic envelope (103), an annular seal (109) is provided.

8. The device according to claim 7, characterized in that the nondeformable body (100) and its heat conductor (101) are guidedly longitudinally movable.

9. The device for carrying out the method according to claim 2, characterized in that, in the low-pressure autoclave (50), in the region of the supporting surfaces of the pressure molds (106), there are provided heat-drawing means (65–67).

10. The device according to claim 7, characterized in that the elastic envelope (103) is surrounded by a rigid, liquid-permeable housing (104).

11. The device according to claim 10, characterized in that the housing (104) has a cylindrical jacket which is provided with perforations (105).

12. The device according to claim 6, characterized in that the heat-drawing means (65–67) contain a liquid medium.

13. The device according to claim 6, characterized in that the heat-drawing means comprise a Peltier-element.

14. The device for carrying out the method according to claim 1, characterized in that the high-pressure autoclave (30) comprises a high-pressure chamber (33) which is mounted in a yoke (10) and held axially.

15. The device according to claim 14, characterized in that the yoke (10) is arranged to be movable in a horizontal plane (H), in the throughput direction.

16. The device according to claim 6, characterized in that the low-pressure autoclave (50) is designed as a cylindrical chamber (53) in the lower face of which are arranged at least the passageways or energy supply for the heat-drawing means (65–67).

17. The device according to claim 16, characterized in that at least the upper face is configured as a threaded closure (54).

* * * * *